US006801235B2

(12) United States Patent
Sasaki

(10) Patent No.: US 6,801,235 B2
(45) Date of Patent: Oct. 5, 2004

(54) IMAGE RECORDING METHOD AND AN IMAGE RECORDING APPARATUS

(75) Inventor: Yoshiharu Sasaki, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 116 days.

(21) Appl. No.: 10/183,425

(22) Filed: Jun. 28, 2002

(65) Prior Publication Data

US 2003/0085986 A1 May 8, 2003

(30) Foreign Application Priority Data

Jul. 3, 2001 (JP) ..... P. 2001-202251

(51) Int. Cl.[7] ..... B41J 2/325
(52) U.S. Cl. ..... 347/176; 347/183
(58) Field of Search ..... 347/176, 183, 347/240, 251, 254

(56) References Cited

U.S. PATENT DOCUMENTS 6,424,366 B1 * 7/2002 Probian et al. ..... 347/156

FOREIGN PATENT DOCUMENTS

EP 920654 B1 * 11/2000 ..... G03F/3/10

OTHER PUBLICATIONS

Frank Cost, Pocket Guide to Digital Printing, 1997, Delmar Publishers, pp. 90–91.*

* cited by examiner

*Primary Examiner*—Lamson Nguyen
*Assistant Examiner*—Blaise Mouttet
(74) *Attorney, Agent, or Firm*—Sughrue Mion, PLLC

(57) ABSTRACT

It is the purpose of the present invention to provide an image recording method and image recording apparatus for performing high-density recording without degrading the resolution. A desired image is recorded on a recording medium by exposing the image on the recording medium while moving the recording medium in the main scan direction where a toner layer of a transfer sheet is overlaid on an image reception layer of an image reception sheet as well as moving a plurality of laser beam spots arranged on the recording medium in the sub-scan direction orthogonal to the main scan direction. In this practice, a recording process on the transfer sheet is repeated a plurality of times to record a same image repeatedly with transfer sheets replaced after the transfer sheet has been exposed.

10 Claims, 4 Drawing Sheets

1. WRAP IMAGE RECEPTION SHEET

2. WRAP K TRANSFER SHEET

3. LAMINATE K (OPTION)

4. LASER RECORDING WITH K DATA

5. PEEL K

6. WRAP R TRANSFER SHEET
7. LAMINATE R (OPTION)
8. LASER RECORDING WITH R DATA
9. PEEL R
10. WRAP G TRANSFER SHEET
11. LAMINATE G (OPTION)
12. LASER RECORDING WITH G DATA
13. PEEL G
14. WRAP B TRANSFER SHEET
15. LAMINATE B (OPTION)
16. LASER RECORDING WITH B DATA
17. PEEL B

IMAGE RECORDING METHOD AND AN IMAGE RECORDING APPARATUS

BACKGROUND OF THE INVENTION

1. Field of the Invention

The present invention relates to an image recording method and image recording apparatus for recording a desired image on a recording target, and in particular to a technology for recording a high-density image at high resolution.

2. Description of the Related Art

A color image recording method is known whereby a transfer sheet having color material layers of Black (K), Cyan (C), Magenta (M) and Yellow (Y) are sequentially overlaid on an image reception sheet having an image reception layer and the color material layers of each transfer sheet are transferred as an image to the image reception layer of the image reception sheet, then finally a latent image transferred to the image reception sheet is transferred to desired printing paper. Such a color image recording method uses as a recording target printing paper including woodfree paper and coat paper.

In case recording is made using typical printing inks via the aforementioned related art recording method, the density of K for example is sufficient as long as a light reflection density of about 1.8 (transmission density of about 0.9) is attained.

In case the aforementioned related art recording method is used to make recording on another recording target, unlike the case of recording on printing paper, there may arise a problem of an insufficient printing density. This occurs, in particular, in such applications as formation of a black matrix of a liquid crystal display and manufacturing of color filters.

A black matrix is a stripe-shaped light shield for shielding against leakage of light between display pixels to enhance the contrast. A color filter serves as a desired optical function layer for example on a transparent substrate to control the transmission wavelength band and typically deposited by an approach such as the photolithography.

In such a recording target, in particular for K, a light transmission density of about 3.0 is required. Thus, the aforementioned related art recording method has failed to assure a sufficient density.

Increasing a film thickness of a color material layer of a transfer sheet may increase the density. However, this also increases the minimum peel size from the sheet of color material layers thus dropping the resolution of a resulting image. By way of example, as shown in Table 4, it is demonstrated that a resolution is approximately proportional to the cube of a film thickness and a transmission density is proportional to a film thickness according to the related art recording method.

TABLE 1

| Film thickness μm | Resolution μm | Transmission density |
|---|---|---|
| 0.50 | 5.0 | 0.9 |
| 0.55 | 6.7 | 0.99 |
| 0.60 | 8.6 | 1.08 |
| 0.65 | 11.0 | 1.17 |
| 0.70 | 13.7 | 1.26 |

TABLE 1-continued

| Film thickness μm | Resolution μm | Transmission density |
|---|---|---|
| 0.75 | 16.9 | 1.35 |
| 0.80 | 20.5 | 1.44 |
| 0.85 | 24.6 | 1.53 |
| 0.90 | 29.2 | 1.62 |
| 0.95 | 34.3 | 1.71 |
| 1.00 | 40.0 | 1.8 |

Thus, while a resolution of 5.0 μm is attained with a film thickness of a color material layer of 0.50 μm, the equivalent resolution has dropped to 40 μm in case the film thickness is doubled, that is, for a film thickness of a color material layer of 1.00 μm. This figure, 40 μm, is virtually unacceptable.

SUMMARY OF THE INVENTION

The invention has been proposed in view of the aforementioned objects and aims at providing an image recording method and image recording apparatus for performing high-density recording without degrading the resolution.

In order to attain the aforementioned objects, an image recording method according to the first aspect of the invention is an image recording method for recording a desired image on a recording medium by exposing the image on the recording medium while moving the recording medium in the main scan direction wherein a toner layer of a transfer sheet is overlaid on an image reception layer of an image reception sheet as well as moving a plurality of laser beam spots arranged on the recording medium in the sub-scan direction orthogonal to the main scan direction, characterized in that a recording process on the transfer sheet is repeated a plurality of times to record a same image repeatedly with transfer sheets replaced after the transfer sheet has been exposed.

According to this image recording method, it is possible to obtain a target recording density by recording a same image a plurality of times with transfer sheets replaced thus repeating the image recording with a toner layer of a transfer sheet having a constant recording resolution while maintaining the film thickness of the toner layer.

An image recording method according to the second aspect of the invention is an image recording method for recording a desired image on the recording medium by using the transfer sheets of a plurality of different colors, comprising a transfer sheet supply process for supplying the transfer sheets of at least one of the colors to a recording section to overlay the sheets on the image reception sheet, an exposure process for exposing an image on the recording medium in the recording section based on desired image information, and a transfer sheet ejecting process for ejecting an exposed transfer sheet from the recording section, characterized in that the image recording method executes the transfer sheet supply process, the exposure process, and the transfer sheet ejecting process a plurality of times in a same color.

According to this image recording method, a transfer sheet supply process, an exposure process, and a transfer sheet ejecting process are repeated for separate transfer sheets of a same color a plurality of times on an image reception sheet supplied in advance in the recording section. Thus, it is made easy to use existing supply, recording, and ejection mechanisms to execute recording of a same image using separate transfer sheets of a same color a plurality of desired times. An exposed transfer sheet once used for recording is ejected and a new transfer sheet of the same color is supplied in the next recording cycle. This allows a toner layer containing a perfect image without loss to be deposited.

An image recording method according to the third aspect of the invention is characterized in that the image recording method repeats recording of an image of the same color with the minimum repetition recordings wherein the recording density accumulated by repeated recording exceeds a target recording density in case the standard recording density obtained by a single exposure is less than the target recording density.

According to this image recording method, recording density is cumulatively summed by repeating recording at a standard recording density. When a cumulative recording density has finally exceeded a target recording density, recording is terminated. Thus, it is possible to obtain a cumulative recording density greater than a target recording density with the minimum repetition recordings while repeating recording at a standard recording density.

An image recording method according to the fourth aspect of the invention is characterized in that the image recording method obtains an integer wherein the split recording density obtained by dividing a target recording density by the integer is maximum and lower than a standard recording density in case the standard recording density obtained by a single exposure is lower than the target recording density.

According to this image recording method, an integer is obtained so that the split recording density obtained by dividing a target recording density by the integer will be maximum and lower than a standard recording density. That is, repeating recording at the split recording density as many times as the integer obtained provides a recording density approximately identical with a target recording density. Thus, the cumulative recording density obtained at completion of a plurality of recordings is approximately identical with the target recording density. This avoids unnecessary recordings thus assuring economical image recording.

An image recording method according to the fifth aspect of the invention is characterized in that recording at a split recording density obtained by dividing a target recording density by the maximum number of repeated recordings allowed is repeated the maximum number of recordings, in case a standard recording density obtained by a single exposure is lower than the target recording density.

According to this image recording method, recording at a split recording density obtained by dividing a target recording density by the maximum number of repeated recordings allowed is repeated the maximum number of recordings. This reduces the number of repetitions required until the target recording density is attained thereby enhancing the productivity.

Image recording apparatus according to the sixth aspect of the invention is image recording apparatus for recording a desired image on a recording medium by exposing the image on the recording medium while moving the recording medium in the main scan direction wherein a toner layer of a transfer sheet is overlaid on an image reception layer of an image reception sheet as well as moving a plurality of laser beam spots arranged on the recording medium in the sub-scan direction orthogonal to the main scan direction, characterized in that the image recording apparatus comprises a controller for controlling exposure of the image on the transfer sheet based on an image recording method according to any one of the first through fifth aspects of the invention.

According to this image recording apparatus, it is possible to obtain a target recording density by control of recording a same image a plurality of times with transfer sheets replaced thus repeating the image recording with a toner layer of a transfer sheet having a constant recording resolution while maintaining the film thickness of the toner layer.

DETAILED DESCRIPTION OF THE PREFERRED EMBODIMENTS

Preferable embodiments of an image recording method and image recording apparatus of the invention will be detailed referring to drawings.

Figure 1:
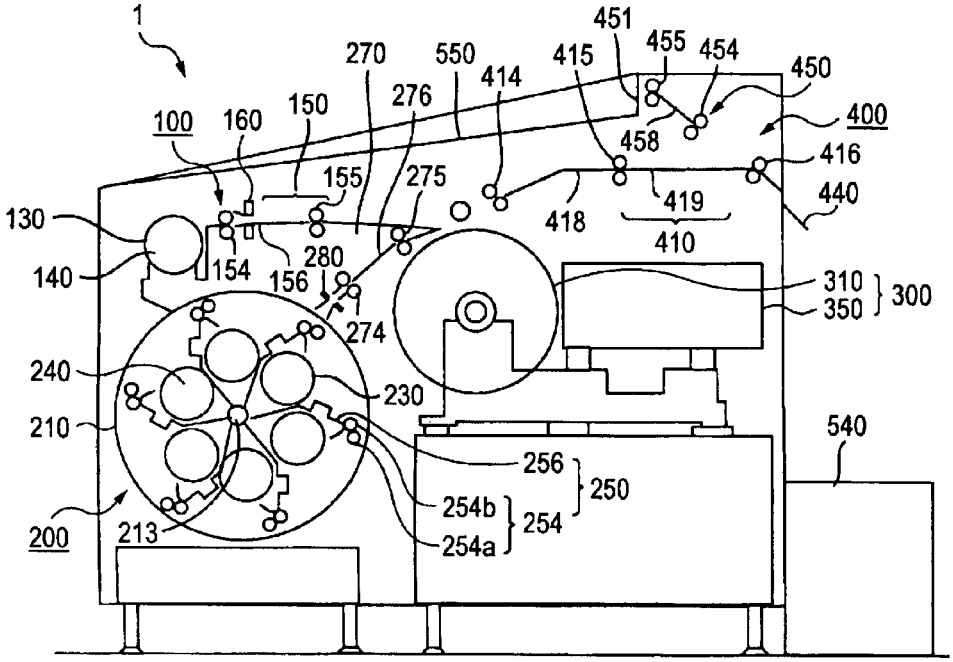
FIG. 1 is a block diagram of image recording apparatus of the invention.
Figure 2:
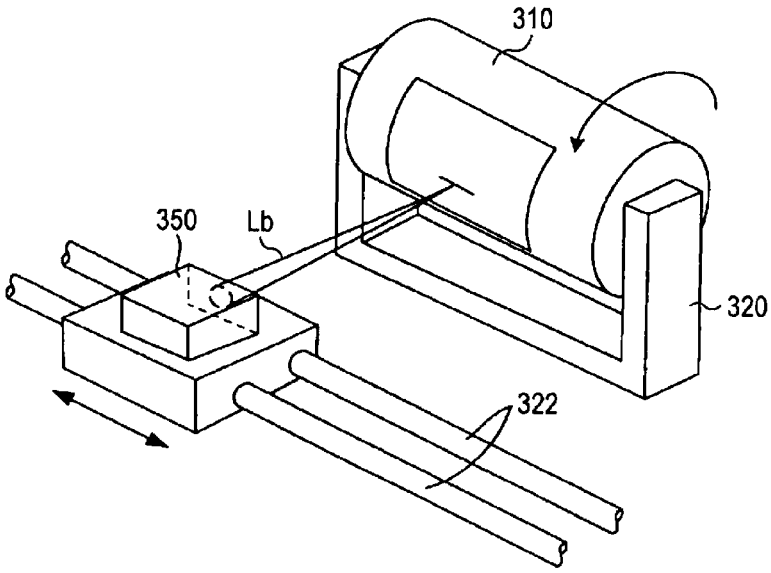
FIG. 2 is an enlarged perspective view of a recording section.
Figure 3:
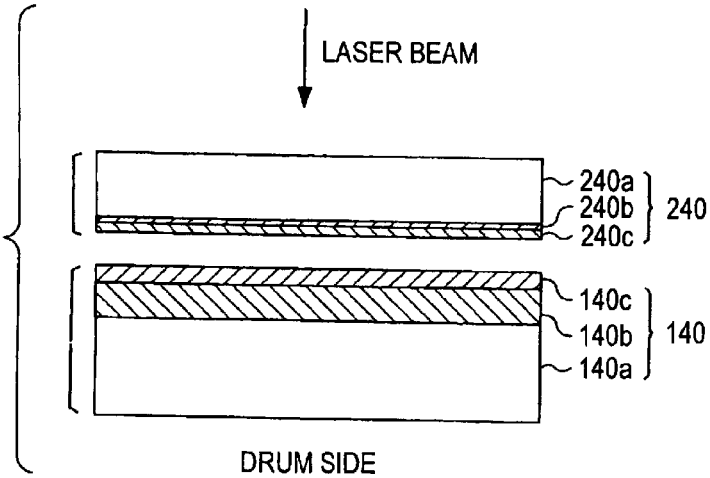
FIG. 3 is a sectional view of an image reception sheet and a transfer sheet used for an image recording method of the invention.
Figure 4:
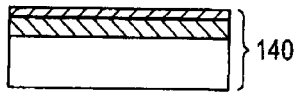
FIG. 4 is an explanatory view showing the concept of a recording process.
Figure 4:
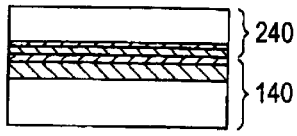
Figure 4:
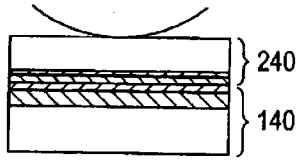
Figure 4:
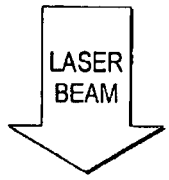
Figure 4:
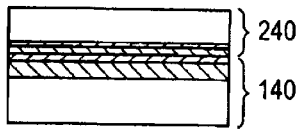
Figure 4:
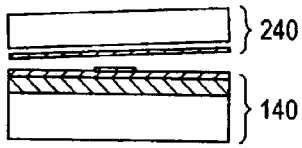
Figure 4:
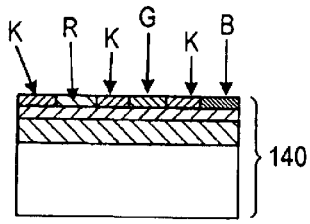
Figure 5:
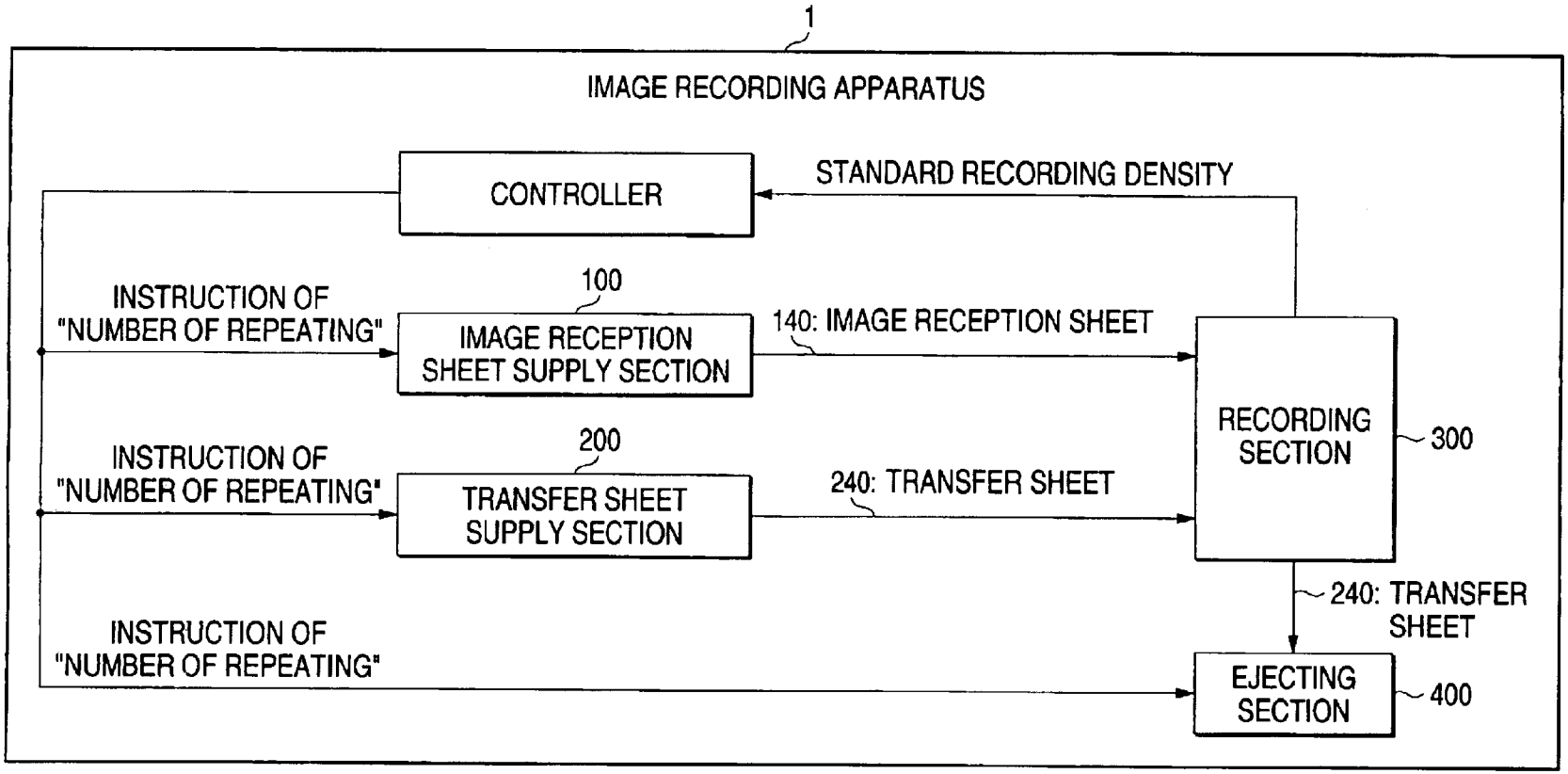
FIG. 5 is a block diagram showing a structure of an image recording apparatus of the invention.

FIG. 1 is a block diagram of image recording apparatus of the invention. FIG. 2 is an enlarged perspective view of a recording section. FIG. 3 is a sectional view of an image reception sheet and a transfer sheet used for an image recording method of the invention. FIG. 4 is an explanatory view showing the concept of a recording process. FIG. 5 is a block diagram showing a structure of an image recording apparatus of the invention.

As shown n FIG. 1, image recording apparatus 1 comprises an image reception sheet supply section 100, a transfer sheet supply section 200, a recording section 300, and an ejecting section 400.

In the image recording apparatus 1, the image reception sheet supply section 100 supplies image reception sheets to the recording section 300. In this embodiment, the reception sheet serves as a display-side transparent substrate of for example a liquid crystal display. The transfer sheet supply section 200 is capable of supplying a plural types of transfer sheets and is capable of selectively supplying one type of transfer sheets out of the plural types of transfer sheets to the recording section 300. In the recording section 300, a transfer sheet is wrapped around an image reception sheet wrapped around a drum 310 as a recording medium fixing member. As shown in FIG. 2, laser exposure of an image is made on a recording medium where a transfer sheet is overlaid on an image reception sheet based on target image information. Toner (color material layer) in the section heated by laser exposure is attached and transferred to the image reception sheet thus forming an image on the image reception sheet by way of degradation of adhesiveness, fusion or sublimation. Toner of the transfer sheets of a plurality of colors (for example, Black, Cyan, Magenta, Yellow)is attached to a same image reception sheet thus forming a color image on the image reception sheet. As mentioned later, this is attained by executing laser exposure while sequentially replacing an exposed transfer sheet with another of a different color with the image reception sheet wrapped around the drum 310. The image reception sheet where this image is formed is ejected via the ejecting section 400 and taken out from the image recording apparatus.

The foregoing description is an outline of the image recording apparatus 1.

Next, the image reception sheet supply section 100, the transfer sheet supply section 200, the recording section 300, and the ejecting section 400 will be sequentially described below.

The image reception sheet supply section 100 has an image reception sheet roll 130. The image reception sheet roll 130 is an image sheet 140 wrapped around a core. The image sheet 140 has a support layer 140*a*, a cushion layer 140*b*, and an image reception layer 140*c* laminated in this order as shown in FIG. 3. The support layer 140*a* may use a PET (polyethylene terephthalate) base, a TAC (triacetyl cellulose)base, or PEN (polyethylene naphthalate) base. The image reception layer 140*c* serves to receive toner to be transferred. The cushion layer 140*b* serves to absorb bump when plural toner layers are overlaid. The image reception sheet roll 130 is wrapped so that the image reception layer 140*c* will cover the support layer 140*a*.

The image reception sheet supply section 100 further has an image reception conveyer section 150. The image reception conveyer section 150 has a motor (not shown), a drive transmission belt or chain (not shown), conveying rollers 154, 155, a support guide 156, and an image reception sheet cutter 160. Such a drive mechanism delivers/returns the image reception sheet 140 toward/from the recording section 300.

The tip of the image reception sheet roll 130 is drawn out by a drive mechanism such as a motor while pinched by the conveying roller 154. Thus, the image reception sheet roll 130 rotates to dispense the image reception sheet 40. The image reception sheet 140 is conveyed while further pinched by the conveying roller 155 and guided by the support guide 156.

The image reception sheet 140 thus conveyed by the image reception sheet conveyer section 150 is cut to a predetermined length by the cutter 160. Conveyance of the image reception sheet 140 is stopped based on the measurement result of the image reception sheet length, and the image reception sheet 140 is cut to a predetermined length.

In this way, the image reception sheet supply section 100 dispenses and cuts part of the image reception sheet roll 130 to supply the image reception sheet 140 to a predetermined length to the recording section 300.

The transfer sheet supply section 200 will be described below.

The transfer sheet has a rotary rack 210. The rotary rack 210 is driven to rotate about a rotation axis 213 as mentioned later. The rotary rack 210 accommodates a plurality (six in the figure) transfer sheet rolls 230 arranged radially about the rotation axis 213.

Each transfer sheet roll 230 has a core and a transfer sheet 240 wrapped around the core. Each transfer sheet roll 230 is held rotatably about each core.

Each transfer sheet 240 has a support layer 240*a*, a photothermal conversion layer 240*b*, and a toner layer 240*c* laminated in this order as shown in FIG. 3. The support layer 240*a* may be a general support material transmitting laser beams (for example the same support material as the aforementioned support layer 140*a*). The photothermal conversion layer 240*b* serves to convert laser energy to heat. The photothermal conversion layer 240*b* may be a general photothermal conversion material converting light energy to thermal energy such as carbon, a black material, an infrared absorption dye and a specific-wavelength absorption material. The toner layer 240*c* comes in toner sheets of Black (K), Cyan (C), Magenta (M) and Yellow (Y).

The transfer sheet roll 230 is wrapped so that the toner layer 240*c* will cover the support layer 240*a*. As mentioned later, the toner layer 240*c* has a toner ink which is transferred to an image reception sheet by a laser exposure.

In FIG. 1, six transfer sheet rolls 230 are accommodated in the rotary rack 210. The six types of transfer sheets may be a combination of four transfer sheets of Black, Cyan, Magenta, Yellow and two special colors (for example gold and silver) or a combination of four transfer sheets of Black, Red, Green, Blue and two special colors (for example gold and silver).

The rotary rack 210 has a transfer sheet dispenser mechanism 250 for each of the plural transfer sheet rolls 230. The transfer sheet dispenser mechanism 250 comprises a feed roller 254 and a support guide 256. The feed roller 254 has rollers 254*a*, 254*b*. The roller 254*a* is driven by a gear mechanism connected to a motor. The roller 254*b* conveys the transfer sheet 240 via rotation opposite that of the roller 254*a*. The transfer sheet 240 is pinched by the rollers 254*a*, 254*b* and may be delivered or returned. Conveyance of the transfer sheet 240 rotates the transfer sheet roll 230.

By the transfer sheet dispenser mechanism 250 having such a structure supplies the transfer sheet 240 to the recording section 300. The transfer sheet 240 is cut to a predetermined length in a transfer sheet conveyer section 270 mentioned later and supplied to the recording section 300. The rotary rack 210 accommodating a plurality of transfer sheet rolls 230 is capable of selectively supplying a desired type of transfer sheet 240 to the transfer sheet conveyer section 270.

The transfer sheet conveyer section 270 of the transfer sheet supply section 200 has conveying rollers 274, 275, a guide 276, and a transfer sheet cutter 280. The rollers 274, 275 are driven by a belt or a chain for driving transmission connected to a motor, and conveys the transfer sheet 240.

With such a drive mechanism, it is possible to deliver/return the transfer sheet 240 toward/from the recording section 300. The transfer sheet 240 thus conveyed is cut to a predetermined length by the transfer sheet cutter 280 and supplied to the recording section 300.

The recording section 300 will be described below.

The recording section 300 has a drum 310. As shown in FIG. 2, the drum 310 has a cylindrical shape and supported rotatably on a frame 320. In the image recording apparatus 1, the rotating direction of the drum 310 is the main scan direction. The drum 310 is linked to the rotation axis of the motor and driven to rotate by the motor. In the surface of the drum 310 are formed a plurality of holes. These holes are connected to suction apparatus such as a blower and a vacuum pump which are not shown.

Operating the suction apparatus with the image reception sheet 140 and the transfer sheet 240 placed on the drum 310 causes these sheets to adhere to the drum 310 by suction.

The drum 310 has a plurality of grooves (not shown) which are aligned in parallel with the rotation axis of the drum 310. Above the drum 310 are aligned a plurality of peeling tabs (not shown) in parallel with the rotation axis of the drum 310.

The recording section 300 has a recording head 350. The recording head is capable of irradiating a laser beam Lb. The toner ink in the position of the transfer sheet 240 where the laser beam is irradiated is transferred to the surface of the image reception sheet 140. The recording head 350 can travel linearly in a direction parallel to the rotation axis of the drum 310 along a guide rail 322 via a drive mechanism (not shown). In the image recording apparatus 1, the travel direction is the sub-scan direction. Thus, it is possible to laser-expose a desired position on the transfer sheet 240 covering the image reception sheet 140. As a result, it is possible to scan the transfer sheet 240 with a laser beam Lb for drawing to laser-expose only the corresponding position based on image information thereby transferring a desired image, for example a pattern of a black matrix or color filter to the image reception sheet 140.

Winding operation of the image reception sheet 140 and the transfer sheet 240 around the drum 310 will be described below.

Around the drum 310 are wound two types of sheets, the image reception sheet 140 and the transfer sheet 240. First, the image reception sheet 140 supplied by the image reception sheet supply section 100 is wound around the drum 310. As mentioned earlier, a plurality of holes (not shown) are formed in the surface of the drum 310 and the image reception sheet 140 is sucked by the suction apparatus (not shown). This causes the image reception sheet 140 to be wound around the drum 310 while adhered to the drum 310 as the drum 310 rotates.

Next, a single transfer sheet 240 supplied from the transfer sheet supply section 200 is wound around the image reception sheet 140. Two types of sheets, the image reception sheet 140 and the transfer sheet 240 are different in size from each other. The transfer sheet 240 is larger than the image reception sheet 140 in both longitudinal and transverse directions. Thus the transfer sheet 240 is wound around the drum 310 while adhered to the drum 310 by a section larger than the image reception sheet 140 as the drum 310 rotates.

The image reception sheet 140 and the transfer sheet 240 wound around the drum 310 are arranged so that the toner layer 240*c* of the transfer sheet 240 contacts the image reception layer 140*c* of the image reception sheet 140. Toner ink in the toner layer 240*c* in this position is laser-exposed by the recording head 350 and transferred to the image reception sheet 140, as mentioned earlier. The transfer sheet 240 where transfer is complete is peeled off the drum 310.

The peeling operation will be described below.

The drum 310 is rotated to a predetermined position for peeling. The tip of a peeling tab is traveled from a standby position that does not come in contact with the drum 310 to a position that comes in contact with the drum 310. This travel is made taking care that the tip of the peeling tab will not come in contact with the surface of the transfer sheet 240. With the rotation of the drum 310, the peeling tab relatively travels on the drum 310 in the direction of its circumference along the surface of the drum 310. The tip of the peeling tab enters a groove provided on the drum surface, slips below the transfer sheet 240 and relatively travels on the surface of the drum 310. This causes the transfer sheet 240 to travel to the upper face of the peeling tab thus being peeled off the drum 310. The transfer sheet 240 peeled by this operation is ejected outside the apparatus via an ejecting section 400 mentioned later.

Next, around the image reception sheet 140 that remains wrapped around the drum 310, the transfer sheet 240 of the same or a different color is wrapped following the aforementioned procedure. With the operation, toner ink in the transfer sheet 240 is transferred to the image reception sheet 140 by way of laser exposure, then the transfer sheet 240 is peeled and ejected.

In a recording method according to the embodiment, the same operation is repeated in a same color using at least one of the colors a plurality of times.

Finally, the image reception sheet 140 where a plural types of toner inks are transferred is peeled. Peeling of the image reception sheet 140 is made the same way as the peeling of the transfer sheet 240. The image reception sheet 140 thus peeled is ejected to the ejecting section 400.

The ejecting section 400 has a common sheet conveyer 410, a transfer sheet ejecting section 440, and an image reception sheet ejecting section 450.

The common sheet conveyer 410 has conveying rollers 414, 415, 416 and support guides 418, 419. The common sheet conveyer 410 further has a movable guide section, which comprises a guide plate (not shown) and a drive mechanism. The guide plate can travel between two positions described later by the drive mechanism.

The transfer sheet ejecting section 440 ejects the processed transfer sheet 240 to a transfer sheet collection box 540.

The image reception sheet ejecting section 450 has an image reception sheet ejecting port 451, rollers 454, 455, and a guide 458. The image reception sheet 140 where an image is transferred is ejected to a tray 550 via the image reception sheet ejecting section 450.

The ejecting section 400 having such a mechanism ejects the image reception sheet 140 and the transfer sheet 240 as mentioned below.

First, ejection of the transfer sheet 240 will be described.

The transfer sheet 240 laser-exposed in the recording section 300 is now unnecessary and peeled off the drum 310. The peeled transfer sheet 240 is delivered while supported by the support guides 418, 419 and pinched by the conveying rollers 414, 415, 416.

Next, ejection of the image reception sheet 140 will be described.

The image reception sheet 140 where toner ink is transferred in the recording section 300 is peeled off the drum 310 and delivered while supported by the support guides 418, 419 and pinched by the conveying rollers 414, 415, 416.

The image reception sheet 140 is conveyed by the conveying rollers 414, 415, 416 and once ejected outside the apparatus. The image reception sheet 140 is not ejected outside in its entirety. Driving by the motor is suspended while the rear end of the image reception sheet 140 is present on the guide plate 419 and pinched by the conveying roller 416. Then reversed rotation of the motor pulls back the image reception sheet 140 toward the image reception sheet ejecting port 451. This sequence is called "switchback" operation. The timing of the drive suspension is determined using a signal from a detection sensor. The detection sensor detects that the rear end of the image reception sheet 140 has passed through the position of the detection sensor, then suspends the motor operation when the image reception sheet 140 has been delivered to a predetermined position.

The movable part of the guide plate 419 is driven by a drive mechanism (not shown). The motor starts reverse rotation which drives each conveying roller 416, 454, 455 in reverse direction. This reverse rotation pulls back the image reception sheet 140. The image reception sheet 140 is conveyed by the conveying rollers 454, 455 to the tray 550 while supported by the guide 458.

The aforementioned operation is controlled by a controller shown in FIG. 5.

The controller controls the image reception sheet supply section 100, the transfer sheet supply section 200, the recording section 300, and the ejecting section 400. The controller controls a drive section having a motor in each of the foregoing sections. In particular, in the recording section 300, the controller further controls an air section such as suction apparatus and an image processor to process image data.

Such an image recording apparatus may be used to form a desired image on the image reception sheet 140. The following describes the operation procedure followed when the four colors Black (K), Red (R), Green (G), Blue (B) are used to form a black matrix and a color filter image.

As shown in FIG. 4, in step 1, the image reception sheet supply section 100 supplies the image reception sheet 140 to the drum 310. The image reception sheet 140 is provided when part of the overlying image reception sheet roll 130 is dispensed and cut away, then wound around the drum 310.

In step 2, the transfer sheet supply section 200 supplies the Black (K) transfer sheet 240 to the drum 310.

Rotation of the rotary rack 210 of the transfer sheet supply section 200 causes the black transfer sheet roll 230 to travel to a position where it faces the transfer sheet conveyer 270. The transfer sheet 240 is provided when part of the overlying transfer sheet roll 230 is dispensed and cut away, then wound around the drum 310. At this time, the front end of the transfer sheet 240 dispensed from the transfer sheet roll 230 is in the close proximity of the cutter 280 external to the rotary rack 210. In this practice, the transfer sheet dispenser mechanism 250, having supplied the transfer sheet 240, can drive the feed roller 254 in the reverse direction to house the front end of the transfer sheet roll 230 inside the periphery of the rotary rack 210. In this case also, the feed roller 254 pinches the front end of the transfer sheet roll 230.

In step 3, the transfer sheet 240 is heated and pressurized then laminated. This laminating process may be skipped.

In step 4, an image is formed as a latent image on the image reception sheet 140 based on preassigned image data. The preassigned image data is color-separated into images of individual colors. Laser exposure is executed based on image data by color separated through color separation process. Based on image data by color separated through color separation process, the recording head 350 irradiates the laser beam spot Lb for drawing on the transfer sheet 240. This causes the toner ink in the transfer sheet 240 to be transferred to the image reception sheet 140 thus forming an image on the image reception sheet 140.

In step 5, only the (K) transfer sheet 240 is peeled off the drum. The transfer sheet 240 peeled off the drum 310 is ejected to the transfer sheet collection box 540.

It is determined whether transfer is complete for the transfer sheets 240 of all the colors. In case another type of transfer sheet 240 must be supplied, steps 2 through 5 are repeated. That is, operation of steps 6 through 17 is repeated for the transfer sheets 240 of the remaining colors Red, Green and Blue. As a result, the toner inks KRGB of the four-color transfer sheets are transferred to a single image reception sheet 140 thus forming a black stripe and color filter pattern on the image reception sheet 140.

In an image recording method according to the embodiment, in a recording process that uses transfer sheets 240 of at least one of the colors, a transfer sheet supply process for supplying the transfer sheets 240 to a recording section 300 to overlay the sheets on the image reception sheet 140, an exposure process for exposing a desired image on the recording medium in the recording section 300, and a transfer sheet ejecting process for ejecting only a transfer sheet 240 from the recording section 300 are respectively executed a plurality of times in a same color. That is, a same image is recorded a plurality of times by using separate transfer sheets 240 of a same color.

To be more precise, when a standard recording density H obtained by single recording is lower than a target recording density, recording at the standard recording density H is repeated as many times as the minimum integer (n times) so that the cumulative recording density Z will exceed the target recording density T. For example, as shown in Table 2, for Black (K), assuming that the standard recording density H is 0.9 and the target recording density T is 3.0, the cumulative recording density Z for four recordings is 3.6. When the number of repeated recordings n is 4, the cumulative recording density Z exceeds the target recording density T and providing the minimum difference from the target recording density T. In the same way, the number of repeated recordings by R, G, B, C, M and Y is obtained.

TABLE 2

| | K | R | G | B | C | M | Y |
|---|---|---|---|---|---|---|---|
| Single exposure | 0.9 | 0.8 | 0.5 | 1.2 | 0.7 | 0.6 | 0.6 |
| Two exposures | 1.8 | 1.6 | 1.0 | 2.4 | 1.4 | 1.2 | 1.2 |
| Three exposures | 2.7 | 2.4 | | 3.6 | 2.1 | 1.8 | |
| Four exposures | 3.6 | | | | | | |
| Target | 3.0 | 2.0 | 0.7 | 3.4 | 1.6 | 1.5 | 1.0 |

In this way, recording density is cumulatively summed each time recording is made, by performing recording a plurality of times at the standard recording density H. When the cumulative recording density Z has finally exceeded the target recording density T, recording is terminated. It is understood that the cumulative recording density Z greater than the target recording density T is obtained at the minimum number of repeated recordings n=4 while recording is repeated at the standard recording density H.

Another recording method is to obtain a recording density approximately identical with the target recording density after repeated recordings. In particular, the number of repeated recordings n is set so that a split recording density S obtained by dividing the target recording density T by the number of repeated recordings n will be maximum and lower than the standard recording density H in case the standard recording density H obtained by a single recording is lower than the target recording density H. Recording is made to obtain the split recording density S in a single recording. The split recording density S is obtained by adjusting the film thickness of the toner layer of the transfer sheet.

In this case, completion of a predetermined number of recordings n obtains a recording density approximately identical with the target recording density T. For example, as shown in Table 3, for Black (K), assuming that the target recording density T is 3.0, the split recording density S obtained by dividing the target recording density T by the number of repeated recordings 4 is 0.75. The split recording density S is lower than the standard recording density H of 0.9 and greater than the value obtained when set to another number of recordings. Performing four recordings at the split recording density S causes the cumulative recording density Z to equal the target recording density T. In the same way, the number of repeated recordings by R, G, B, C, M and Y is obtained.

TABLE 3

| | K | R | G | B | C | M | Y |
|---|---|---|---|---|---|---|---|
| Single exposure | 0.75 | 0.67 | 0.35 | 1.13 | 1.53 | 0.50 | 0.50 |
| Two exposures | 1.5 | 1.3 | 0.7 | 2.3 | 1.1 | 1.0 | 1.0 |
| Three exposures | 2.3 | 2.0 | | 3.4 | 1.6 | 1.5 | |
| Four exposures | 3.0 | | | | | | |
| Target | 3.0 | 2.0 | 0.7 | 3.4 | 1.6 | 1.5 | 1.0 |

In this way, obtaining the number of repeated recordings n so that a split recording density S obtained by dividing the target recording density T by the number of repeated recordings n will be maximum and lower than the standard recording density H then repeating recording n times at the split recording density S provides a recording density approximately identical with the target recording density T. Thus, the cumulative recording density Z obtained when a plurality of recordings are complete is always approximately identical with the target recording density T. This avoids unnecessary recordings thus assuring economical image recording.

Another recording method is to obtain the target recording density with the minimum number of repeated recordings. In particular, the recording density is set to the split recording density S obtained by dividing the target recording density T by the maximum number of repeated recordings n allowed (by adjusting the film thickness of the toner layer of the transfer sheet), and recording is performed n times at this split recording density S. The maximum number of repeated recordings is preferably up to four in consideration of the productivity.

For example, as shown in Table 4, for Black (K), assuming that the target recording density T is 3.0, the split recording density S obtained by dividing the target recording density T by the maximum number of repeated recordings n=2 is 1.50. The split recording density S is great r than the standard recording density H. Performing two recordings at the split recording density S causes the cumulative recording density Z to approximately equal the target recording density T. In the same way, the number of repeated recordings by R, G, B, C, M and Y is obtained.

TABLE 4

| | K | R | G | B | C | M | Y |
|---|---|---|---|---|---|---|---|
| Single exposure | 1.50 | 1.00 | 0.70 | 1.70 | 0.08 | 0.75 | 0.50 |
| Two exposures | 3.0 | 2.0 | | 3.4 | 1.6 | 1.5 | 1.0 |
| Target | 3.0 | 2.0 | 0.7 | 3.4 | 1.6 | 1.5 | 1.0 |

In this way, by setting a value obtained by dividing the target recording density T by the maximum number of repeated recordings n as the split recording density S, the split recording density S obtained in a single recording becomes greater than the standard recording density H. This reduces the number of repetitions required until the target recording density T is attained thereby enhancing the productivity.

In this way, when recording is terminated, it is determined that laser exposure of an image on the final transfer sheet 240 is complete.

The image reception sheet 140 is peeled off the drum 310. The peeled image reception sheet 140 undergoes switchback operation via the ejecting section 400 and ejected to the tray 550. This completes formation of an image on the image reception sheet 140 as a flexible display-side transparent substrate.

While the foregoing embodiment shows as an example a recording medium fixing member of outer drum type, an image recording method of the invention may use a recording medium fixing member of flat table type that can travel in the main scan direction. Using a recording medium fixing member of such a configuration assures the same recording process even when the display-side transparent substrate of a liquid crystal display is a glass substrate without flexibility.

As detailed hereabove, according to an image recording method and image recording apparatus of the invention, a same image is repeatedly recorded a plurality of times using separate transfer sheets of a same color thus summing recordings at a film thickness with constant resolution. This reduces degradation of resolution that may occur when a single recording is made using a thick toner layer and obtains a high-resolution, high-density image. This allows a high-resolution pattern at high accuracy that serves as a black matrix or color filter.

What is claimed is:

1. An image recording method for recording a desired image on a recording medium wherein said recording medium consist of a toner layer of a transfer sheet and an image reception layer oil an image reception sheet lying on said toner layer, said method comprising the steps of:

exposing aid image on said recording medium while moving said recording medium in a main scan direction as well as moving a plurality of laser beam spots arranged on said recording medium in a sub-scan direction orthogonal to said main scan direction, replacing said transfer sheet with an alternative transfer sheet after said step of exposing, re-recording said same image by exposing said alternative transfer sheet, and repeating said steps of replacing and re-recording a plurality of times.

2. The image recording method according to claim 1, wherein said step of repeating is executed if a standard recording density obtained by said step of exposing at first is lower than said target recording density, and repeats said steps of replacing and re-recording a minimum times so that a recording density accumulated by repeating exceed said target recording density.

3. The image recording method according to claim 1, wherein said step of repeating is executed if a standard recording density obtained by said step of exposing at first is less than said target recording density, and repeats said steps of replacing and re-recording an integral number of times, wherein said integral number is obtained so that a split recording density is lower than said standard recording density and is maximum, and wherein said split recording density is obtained by dividing a target recording density by said integral number.

4. The image recording method according to claim 1, wherein said step of repeating is executed if a standard recording density obtained by said step of exposing at first is lower than said target recording density, and repeats said steps of replacing and re-recording an integral number of times, wherein said integral number is a maximum number of repeated recordings allowed, and wherein said split recording density is obtained by dividing a target recording density by said maximum number of repeated recordings allowed.

5. An image recording method for recording a desired image on a recording medium wherein said recording medium consist of a toner layer of a transfer sheet and an image reception layer of an image reception sheet lying on said toner layer by using said transfer sheets of a plurality of different colors, said method comprising the steps of:

supplying of transfer sheet for supplying said transfer sheets of at least one of the colors to a recording section to overlay said sheets on said image reception sheet, exposing for exposing an image on the recording medium in said recording section based on information of said image, ejecting or transfer sheet for ejecting said transfer sheet from said recording section, and repeating said steps of supplying, exposing, and ejecting a plurality of times regarding a same color.

6. The image recording method according to claim 5, wherein said step of repeating is executed if a standard recording density obtained by said step of exposing at first is lower than said target recording density, and repeats said steps of supplying, exposing, and ejecting a minimum times regarding a same color so that a recording density accumulated by repeating exceeds said target recording density.

7. The image recording method according to claim 5, wherein said step of repeating is executed if a standard recording density obtained by said step of exposing at first is less than said target recording density, and repeats said steps of supplying, exposing, and ejecting an integral number of times regarding a same color, wherein said integral number is obtained so that a split recording density is lower than said standard recording density and is maximum, and wherein said split recording density is obtained by dividing a target recording density by said integral number.

8. The image recording method according to claim 5, wherein said step of repeating is executed if a standard recording density obtained by said step of exposing at first is lower than said target recording density, and repeats said steps of supplying, exposing, and ejecting an integral number of times regarding a same color, wherein said integral number is a maximum number of repeated recordings allowed, and wherein said split recording density is obtained by dividing a target recording density by said maximum number of repeated recordings allowed.

9. An image recording apparatus for recording a desired image on a recording medium wherein said recording medium consist of a toner layer of a transfer sheet and an image reception layer of an image reception sheet lying on said toner layer, said apparatus comprising:

a recording section including a drum and a recording head, wherein said recording head is capable to irradiating a laser beam in order to laser-expose, an image reception sheet supply section for supplying an image reception sheet to said recording section, a transfer sheet supply section for supplying a transfer sheet on said image reception sheet supplied to said recording section, an ejecting section for ejecting said transfer sheet from said recording section, and a controller for controlling exposure in said recording section based on an image recording method including the steps of exposing said image on said recording medium while moving said recording medium in a main scan direction as well as moving a plurality of laser beam spots arranged on said recording medium in a sub-scan direction orthogonal to said main scan direction, replacing said transfer sheet with an alternative transfer sheet after said step of exposing, re-recording said same image by exposing said alternative transfer sheet, and repeating said steps of replacing and re-recording a plurality of times.

10. An image recording apparatus for recording a desired image on a recording medium wherein said recording medium consist of a toner layer of a transfer sheet and an image reception layer of an image reception sheet lying on said toner layer, said apparatus comprising:

a recording section including a drum and a recording head, wherein said recording head is capable to irradiating a laser beam in order to laser-expose, an image reception sheet supply section for supplying an image reception sheet to said recording section, a transfer sheet supply section for supplying a transfer sheet on said image reception sheet supplied to aid recording section, an ejecting section for ejecting said transfer sheet from said recording section, and a controller for controlling exposure in said recording section based on an image recording meth including the steps of supplying of transfer sheet for supplying said transfer sheets of at least ne of the colors to the recording section to overlay said sheets on said image reception sheet, exposing for exposing an image on the recording medium in said recording section based on information of said image, ejecting of transfer sheet for ejecting said transfer sheet from said recording section, and repeating said steps of supplying, exposing, and ejecting a plurality of times regarding a same color.

* * * * *